US006823841B2

(12) United States Patent
Schmolla

(10) Patent No.: US 6,823,841 B2
(45) Date of Patent: Nov. 30, 2004

(54) IGNITION SYSTEM FOR INTERNAL COMBUSTION ENGINES

(75) Inventor: Wilfried Schmolla, Dietzenbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/476,683

(22) PCT Filed: Apr. 11, 2002

(86) PCT No.: PCT/EP02/04017

§ 371 (c)(1),
(2), (4) Date: May 18, 2004

(87) PCT Pub. No.: WO02/090767

PCT Pub. Date: Nov. 14, 2002

(65) Prior Publication Data

US 2004/0211401 A1 Oct. 28, 2004

(30) Foreign Application Priority Data

May 5, 2001 (DE) ..... 101 21 993

(51) Int. Cl.[7] ..... F02P 5/00
(52) U.S. Cl. ..... 123/406.12
(58) Field of Search ..... 123/406.12, 406.19, 123/406.23, 406.33, 406.11

(56) References Cited

U.S. PATENT DOCUMENTS 5,426,036 A * 6/1995 Koller et al. ..... 435/69.7

FOREIGN PATENT DOCUMENTS

| | | |
|---|---|---|
| DE | 24 44 242 | 9/1974 |
| DE | 26 23 865 | 5/1976 |
| DE | 42 26 246 A1 | 8/1992 |
| DE | 197 00 179 C2 | 1/1997 |
| DE | 198 40 765 A1 | 9/1998 |
| DE | 198 41 483 A1 | 9/1998 |
| DE | 199 62 368 C1 | 12/1999 |
| DE | 100 23 835 A1 | 5/2000 |
| DE | 100 37 528 A1 | 8/2000 |
| EP | 0 750 112 A2 | 6/1996 |
| JP | 2000-337235 | 5/2000 |

* cited by examiner

*Primary Examiner*—Bibhu Mohanty
(74) *Attorney, Agent, or Firm*—Crowell & Moring LLP

(57) ABSTRACT

The invention relates to an ignition system for a 14 V or 42 V on-board power system voltage which is connected to the ignition transformer directly via the semiconductor power output stage without an intermediate power unit. After an input signal from a superordinate engine control device, the semiconductor power output stage is switched on by an ignition control device. As a result, a current is built up at the primary side of the ignition transformer. After the predefined maximum current value is reached for the first time, the primary side of the ignition transformer is switched off for a predefined time period. In this time period, a maximum voltage for the spark breakdown is built up at the electrodes of the spark plug according to the principle of self induction. After the spark discharge, the primary side of the ignition transformer is timed and current-limited until the end of the ignition process which is predefined by the superordinate engine control device. The timed control operates with selected, predefined time intervals for switching the semiconductor power output stage alternately on and off. A current limitation is superimposed on the timed control and switches off the primary side of the ignition transformer whenever the primary current reaches a predefined maximum value.

12 Claims, 3 Drawing Sheets

IGNITION SYSTEM FOR INTERNAL COMBUSTION ENGINES

BACKGROUND AND SUMMARY OF THE INVENTION

This application claims the priority of German patent document 101 21 993.8, filed 5 May 2001 (PCT International Application No.: PCT/EP02/04017), the disclosure of which is expressly incorporated by reference herein.

The invention relates to a hybrid ignition system for internal combustion engine having 14 V or 42 V on-board power system voltages with a timed and current-controlled ignition stage having two operating phases.

In ignition systems of this type, during a first phase, a self-induction voltage for the spark breakdown is generated from the energy stored in the magnetic field of the ignition transformer. In a second phase, the ignition system with timed control of the ignition stage and superimposed current limitation generates an alternating voltage for the ignition spark so that the ignition spark is fired without interruption even when there is an increased requirement for firing voltage due to gas flowing at the spark location. The hybrid ignition system does not require any intermediate power unit.

The invention is based on an ignition system such as is described, for example, in German patent document DE 197 00 179 C2 from Bosch, which operates according to the resonant converter principle. A typical design contains an intermediate power unit which steps up the on-board power system voltage of the on-board power system generator to values on the order of magnitude of 200 V on the primary side of the ignition transformer (which is embodied as a resonant converter). A semiconductor power output stage is actuated using a control device and the current on the primary side of the ignition transformer is interrupted when a predefined, variable switch-off current is reached. The current on the secondary side of the ignition transformer corresponds to the spark current and results from the transmission ratio of the ignition transformer, specifically essentially from the primary current, the coupling factor of the ignition transformer and the square root of the ratio of the inductances on the primary side and the secondary side.

Alternating current ignition systems have the advantage over capacitively or purely inductively operating ignition systems that the ignition energy from the intermediate power unit is transmitted continuously to the ignition spark. The maximum firing period of the ignition spark is determined by the maximum power of the intermediate power unit of the ignition system. By combining spark ignition and ion current measuring technologies, closed control circuits are obtained which make it possible for the entire ignition process including the spark plug and ignition spark to be continuously monitored and operated with the smallest possible spark current, and thus lowest possible degree of spark plug erosion.

Previously described alternating current ignition systems have the disadvantage of requiring a power unit, for generating an intermediate voltage of approximately 200 V, and a resonant converter as an ignition stage. The power unit and the resonant converter give rise to additional manufacturing and installation costs.

One object of the present invention therefore, is to provide a suitable ignition system that does not require an intermediate power unit or a resonant converter, and achieves the advantages of alternating current ignition systems.

German patent document DE 42 26 246 A1 discloses an ignition system for an internal combustion engine with subsequent spark ignition. Pure current control is carried out without timed control of the switch on and switch off times. In the process spark pauses and subsequent spark ignition occur.

German patent document DE 198 40 765 A1, on the other hand, discloses a method and a circuit arrangement for an ignition system of an internal combustion engine, in which resonant ignition with a preceding self induction phase is carried out without any mention of current control or timed control.

Finally, German patent document DE 24 44 242 A1 discloses an ignition system for an internal combustion engine which generates an ignition spark or a light arc of a predefined, relatively prolonged duration for each engine cylinder and has the capability of igniting again at successive times during such a period. In the process, timed control of the primary current is carried out with superimposed current control. The latter is carried out only in each case for the first time period, and is maintained without modification during the entire ignition enable time. 500 $\mu$s are provided for the first and second time periods (switch on and switch off times) so that the ignition can operate advantageously. In addition, the limiting resistance of 30 k$\Omega$ is provided in the spark plug circuit owing to the long switch on time.

However, in such ignition systems, a long switch on time and a limiting resistance are necessary in the spark plug circuit, with the result that the circuit design is more complex and costly.

Accordingly, another object of the present invention is to provide an ignition system of the generic type which is of relatively simple design, and in which a switch-on time is significantly reduced.

These and other objects and advantages are achieved by the ignition system according to the invention for a 14 V or 42 V on-board power system voltage, which is applied directly to the ignition stage without an intermediate power unit. After an input signal from a superordinate engine control device, the semiconductor power output stage is switched on by an ignition control device. As a result, a current is built up on the primary side of the ignition transformer. After a predefined maximum current value is reached for the first time, the primary side of the ignition transformer is switched off for a predefined time period. In this time period, a high voltage for the spark breakdown builds up, according to the principle of self induction, at the electrodes of the spark plug which is connected at the secondary side to the ignition transformer. After the spark breakdown, the primary side of the ignition transformer is timed and current-controlled until the end of the ignition process which is predefined by the superordinate engine control device.

The timed control operates with selected, predefined time intervals in which the semiconductor power stage is alternately switched on and off. The switch-on time is selected to be so short that when the efficiency of the ignition plasma decreases owing to the limited voltage supply from the product of the on-board power system voltage and transmission ratio of the ignition transformer after a short time, a relatively high self-induction voltage is provided again during the switch-off time. The switch-on time is however selected to be of such a length that an intermittent buildup of the stored energy takes place if there is little energy stored. In order to build up high voltage for the first spark breakdown, a large amount of energy is required so that energy has to be recharged again. The switch-off time is also selected to be as short as possible so that the drop in the energy stored in the ignition transformer during the switch-off time is small. Typical values are 10–200 μs for the switch-on time, and 5–50 μs for the switch-off time. A current limitation is superimposed on the timed control and it switches off the primary side of the ignition transformer whenever the primary current reaches the predefined maximum value.

The maximum current limitation protects the components of the ignition system, and the on-board power system against overloading. In conjunction with a high coupling factor of the ignition transformer, the maximum current limitation also advantageously limits the ignition spark current during the switch-on time.

The following advantages are achieved with the invention:

The ignition transformer has a transmission ratio ü which is greater than 100 for an on-board power system voltage of 14 V, and greater than 50 for an on-board power system voltage of 42 V. The large transmission ratio of the ignition transformer permits the on-board power system voltage to be connected directly to the ignition stage. As a result, the intermediate power unit which is customary with alternating current ignition systems and with which the on-board power system voltage is stepped up to 200 V, is advantageously dispensed with.

The resonant oscillatory circuit which is otherwise necessary with alternating current ignition systems is dispensed with as a result of the timed control of the ignition spark after the spark breakdown with repeated switching on and off of the primary side, and a coupling factor of the ignition transformer>0.7. The switching on and off processes bring about an alternating current in the ignition stage, and thus also at the spark plug, according to the forward converter principle and self-induction or flyback converter principle.

By repeatedly switching on the primary current, energy is repeatedly supplied from the on-board power system into the ignition transformer. The overall energy which is necessary for igniting the fuel mixture therefore does not need to be stored as an entire energy package in the ignition coil or in an intermediate power unit. It is sufficient to store small quantities of energy in the ignition transformer in order to maintain the ignition spark. This permits a compact design of the ignition transformer and makes it possible to use rod ignition transformers, such as described, for example, in German patent documents DE 198 40 765 A1, and DE 199 62 368 which are not prior art.

As the firing period of the invention is determined by the timed control of the engine control device, and not by the energy content in the ignition transformer or an intermediate power unit as in the prior art, the firing period of the invention can be made variable. The relatively small energy content of the ignition transformer also results in a short burn-out time of the ignition spark at the end of the firing period, which in turn has a positive effect on ion current measurement. A long post-firing period falsifies the results of an ion current measurement since due to the post-firing period the measurement results are superimposed on those of the actual ion current measurement.

If the ignition spark is fanned by a stream of gas in the cylinder, the ignition system according to the invention has the capability of supplying a correspondingly high burn voltage, and of restarting the ignition spark in the vicinity of the electrodes with the necessary breakdown voltage when there are very high burning voltages. Once the spark breakdown has taken place and the burning mixture is already ionized, a significantly lower breakdown voltage is sufficient for the renewed spark breakdown. However, with the invention, this breakdown voltage is reached again whenever the primary current is switched off by the timed control, so that it is possible to re-ignite repeatedly over the entire firing period if there is a strong flow against the ignition spark.

This post-ignition reserve is advantageously built up if, during the firing period in the switch-on time a portion of the primary current is used to maintain the ignition spark and a portion of the primary current is used to build up a magnetic field in the ignition transformer.

If the ignition spark is undesirably extinguished, the ignition system according to the invention optionally has the ability to post-ignite the ignition spark. For this purpose, the connection of the semiconductor power output stage to the primary winding L1 of the ignition transformer is formed with an optional reverse blocking diode D1. The effect of the diode is that when an ignition spark ends, the self-induction voltage at L1 at the connection to D1 can oscillate from positive voltages to negative voltages and back with the natural frequency of the ignition transformer. As a result, during the switch-off time, energy is stored back in the ignition transformer. The ignition transformer is provided with a post-ignition reserve. During the switch-on time, additional energy is stored in the ignition transformer. With the stored energy, a high voltage for a renewed spark breakdown is built up on the secondary side of the ignition transformer at L2 for the spark plug during the switch-off time. The process continues up to a renewed spark breakdown.

Other objects, advantages and novel features of the present invention will become apparent from the following detailed description of the invention when considered in conjunction with the accompanying drawings.

DETAILED DESCRIPTION OF THE DRAWINGS

Figure 1:
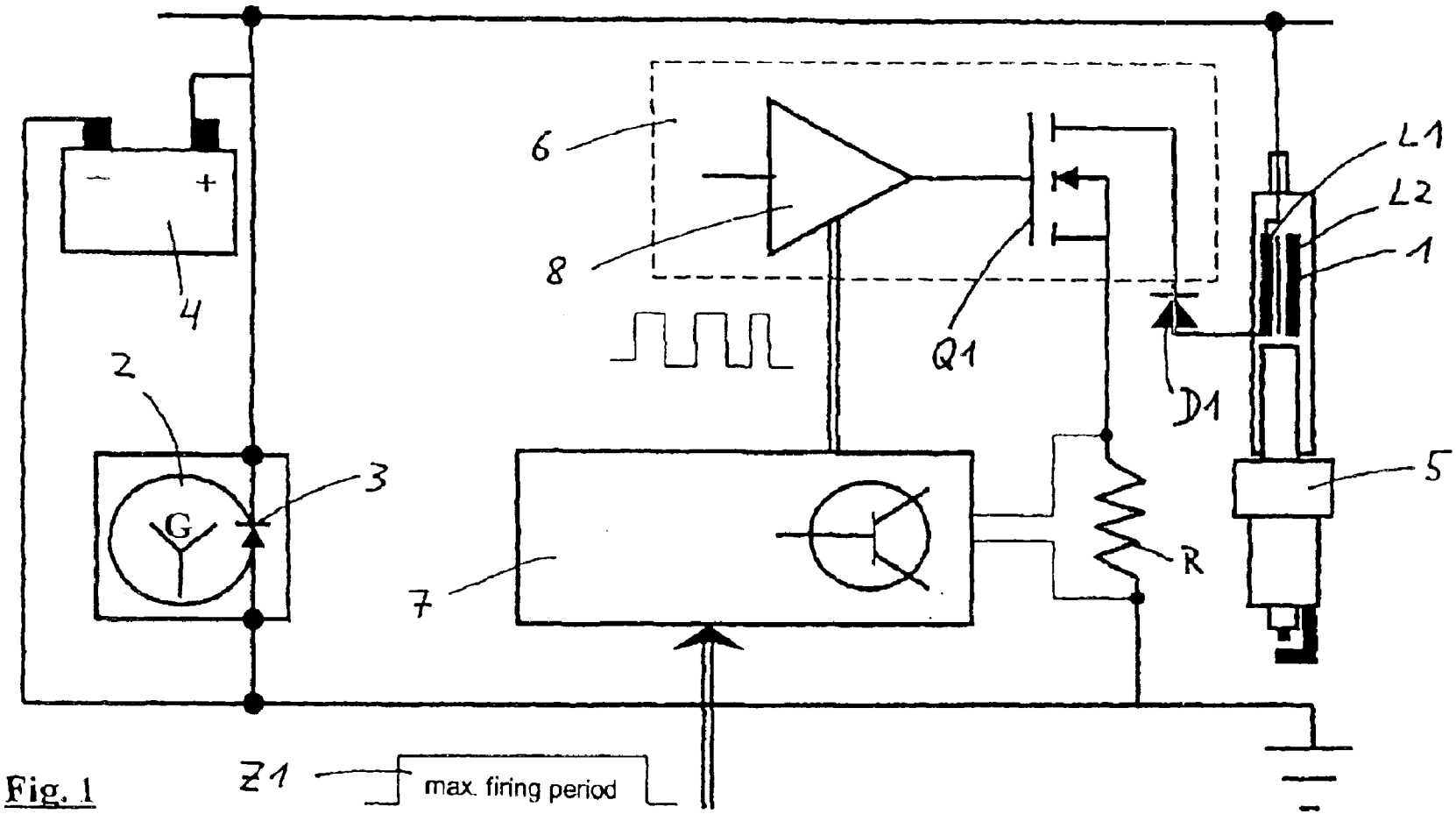
FIG. 1 is a schematic view of the ignition system according to the invention.

FIG. 1 is a schematic diagram of the invention. The on-board power system voltage which is generated by an on-board power system generator 2 with integrated rectifier bridge 3 and an on-board power system battery 4, is applied via a semiconductor power stage 6 and an optional diode D1 to a transformer which is embodied as ignition transformer 1 with a primary winding L1 and a secondary winding L2. The secondary side L2 of the ignition transformer is connected to the electrodes of a spark plug S.

Advantageously, the spark plug and ignition transformer are shown as an integrated rod ignition transformer in the illustrated exemplary embodiment. The ignition transformer and the spark plug can also be embodied, however, as separated components connected to one another via electrical lines. The primary side L1 of the ignition transformer is connected at one other end to the positive voltage rail of the on-board power system voltage and is connected at its second side to a semiconductor power output stage 6 and a current sensor, which is embodied here as measurement resistor R, on the ground line of the on-board power system voltage.

The semiconductor power output stage 6 is driven by an ignition control device 7. The ignition control device, the semiconductor power stage 6 and the current sensor R form an exemplary embodiment of the electronic ignition system. The electronic ignition system is not restricted to this embodiment. It is also possible to use, as the current sensor, a current probe with which the current in the primary coil is measured.

The power stage does not necessarily need to be embodied as a semiconductor power stage. The division between the ignition control device and engine control device is merely conceptual and determined according to practical conditions in terms of the application. In particular, the ignition control device may be formed as a unit with an engine control device. However, an integrated electronic ignition system which is integrated as an integrated circuit into a rod ignition transformer is preferred.

Figure 2:
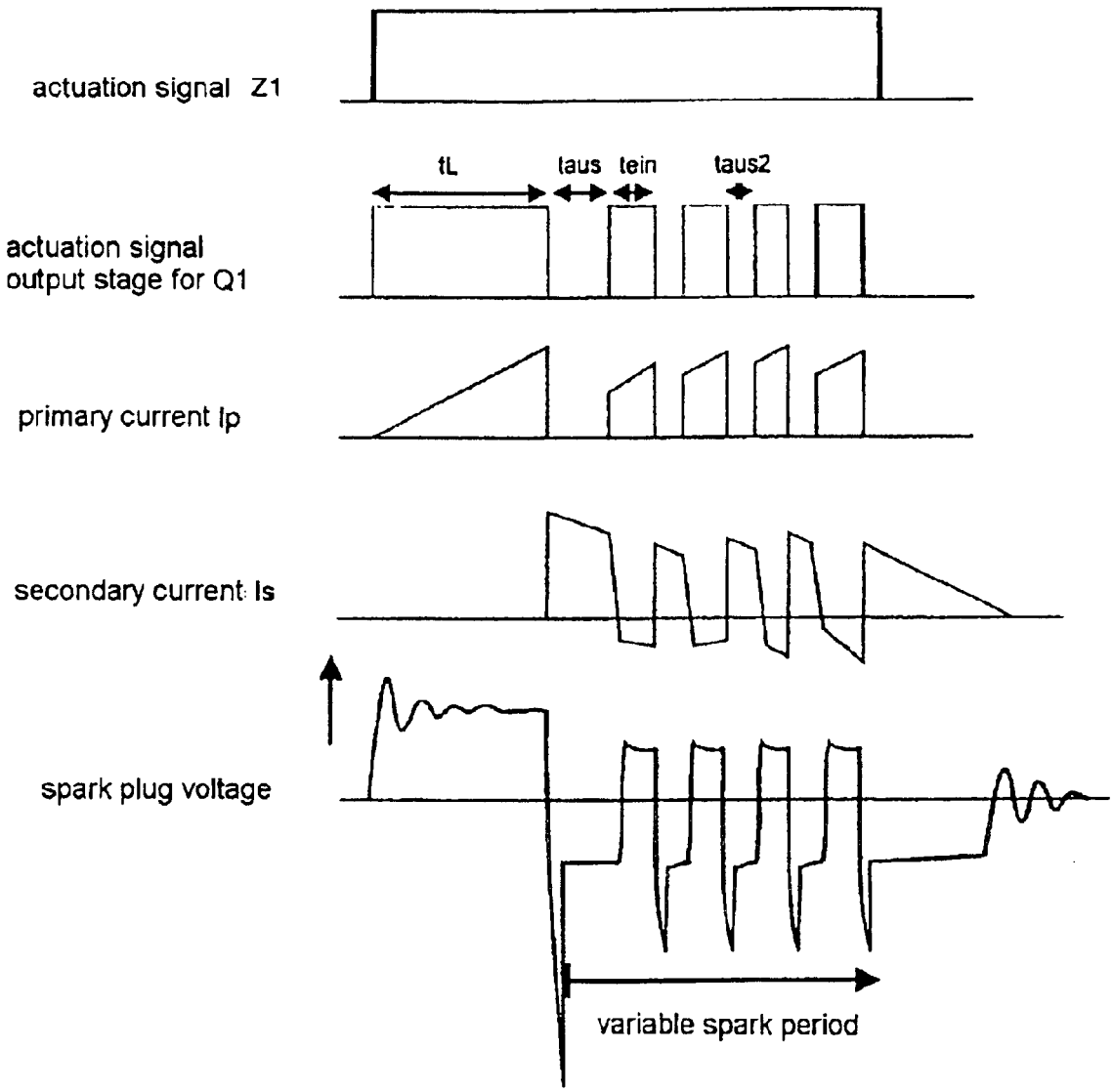
FIG. 2 are schematic voltage and current time diagrams in relation to the drive signals for an ignition system according to the invention.

The signal profile and the current and voltage/time diagrams which are brought about with the signal profile at the electrodes of the spark plug are illustrated in FIG. 2. The ignition control device receives, from a superordinate engine control device or from a crank and camshaft sensor, an actuation signal Z1 which predefines a time window within which the ignition spark fires and ignition can take place in the combustion chamber of an engine cylinder. After the actuation signal Z1 is supplied to the ignition control device 7, the latter switches on the semiconductor power stage 6. The semiconductor power stage includes a suitable amplifier circuit 8 for actuating the output stage Q1, which is advantageously a MOSFET or IGBT whose gate is actuated by the amplifier circuit 8.

After the output stage Q1 is switched on by actuating the gate of the MOSFET, the primary side L1 of the ignition transformer is conductively connected to the two voltage levels of the on-board power system. As a result, a primary current Ip builds up in the ignition transformer. This primary current is detected using a current sensor and sensed by the ignition control device 7. In the exemplary embodiment in FIG. 1, the current sensor is formed by a measuring resistor R1 in the ground line of the primary side L1 and a voltage tap connected to the ignition control device. If the primary current reaches a preset limiting value Ip+m which is stored in the ignition control device, the latter switches off the output stage Q1 for a predefined time $t_{off}$. As a result, a high voltage for the spark breakdown at the electrodes of the spark plug builds up by self induction on the secondary side L2 of the ignition transformer. After the time period $t_{off}$, the current on the primary side is switched on again for a time $t_{on}$ which is also predefined; it is switched off again for a further predefined time period $t_{off2}$ after the time period $t_{on}$. The switching on and switching off operations of the primary current repeat cyclically, until the end of the maximum firing period which is predefined by the actuation signal Z1. As a result, an alternating voltage is produced at the electrodes of the spark plug until the end of the actuation signal Z1.

A maximum current limitation is superimposed on this pure timed control of the primary current on the basis of predefined time intervals for the entire period for which the actuation signal Z1 is applied. This maximum current limitation always switches off the primary current independently of the timed control whenever the primary current exceeds the predefined maximum value Ip+m. The maximum current limitation protects the components of the ignition system and the on-board power system against overloading. The ignition spark current is also advantageously limited during the switch on time by the maximum current limitation, in conjunction with a high coupling factor of the ignition transformer.

As the maximum firing period varies as a function of the rotational speed of the crankshaft, the time window for the maximum firing period also changes with the rotational speed of the crankshaft.

The maximum firing period forms the length of the actuation signal Z1 together with the charge time tL for the first spark breakdown. As a result, the firing period of the spark plug is kept variable and adapted to engine speed. At the end of the actuation signal Z1, the timed control and the current limitation in the ignition control device are interrupted until the next time a new actuation signal is applied. As a result, the output stage Q1 is also switched off so that there is monitored switching off of the ignition spark at the end of the actuation signal Z1.

In order to achieve the best possible utilization of the primary current, a high coupling factor is sought. By changing the primary-side switch-off current, it is possible to control the spark current in the spark plug and thus adapt it to various combustion chamber conditions in the cylinder. An ignition transformer which is suitable for the invention has a coupling factor k in the region of 0.7 to 0.99, a transmission ratio ü greater than or equal to 100 for on-board power system rated voltages of 12 V to 14 V and a transmission ratio ü greater than or equal to 50 for on-board power system rated voltages of 42 V. The transmission ratio of the transformer is defined as the product of the coupling factor k and the square root formed from the ratio of the inductances of the secondary side L2 with respect to the primary side L1:

$$\ddot{u}=k\sqrt{L2/L1}$$

As a result of the transmission ratios, which are relatively high for ignition stages, and as a result of the continuous subsequent supply of ignition energy by the timed control of the primary current, it is possible to dispense with an intermediate power unit and with a resonant oscillatory circuit.

The predefined time parameters tL, $t_{off}$, $t_{on}$, $t_{off2}$ depend on the operating conditions in the combustion chamber of the internal combustion engine and on the configuration of the ignition transformer. The values are fixed with respect to the respective current operating conditions of the engine, but can easily assume other values when the operating conditions change, for example as a result of a change in the engine speed of the engine load or the engine temperature. Given a primary-side current limitation of 20–30 A, a parameter range for the charge period tL of 200 $\mu$s to 500 $\mu$s is obtained for a 14 V on-board power system, and a charge period tL of 501 $\mu$s to 200 $\mu$s is obtained for a 42 V on-board power system. A parameter range of 10 $\mu$s to 200 $\mu$s is obtained for both on-board power system voltages for the switch on time $t_{on}$. The parameter range of 5 $\mu$s to 50 $\mu$s is also respectively obtained for the two switch offtimes $t_{off}$ and $t_{off2}$ for both on-board power system voltages. The coupling factor of the ignition transformer is preferably k=0.95.

Figure 3:
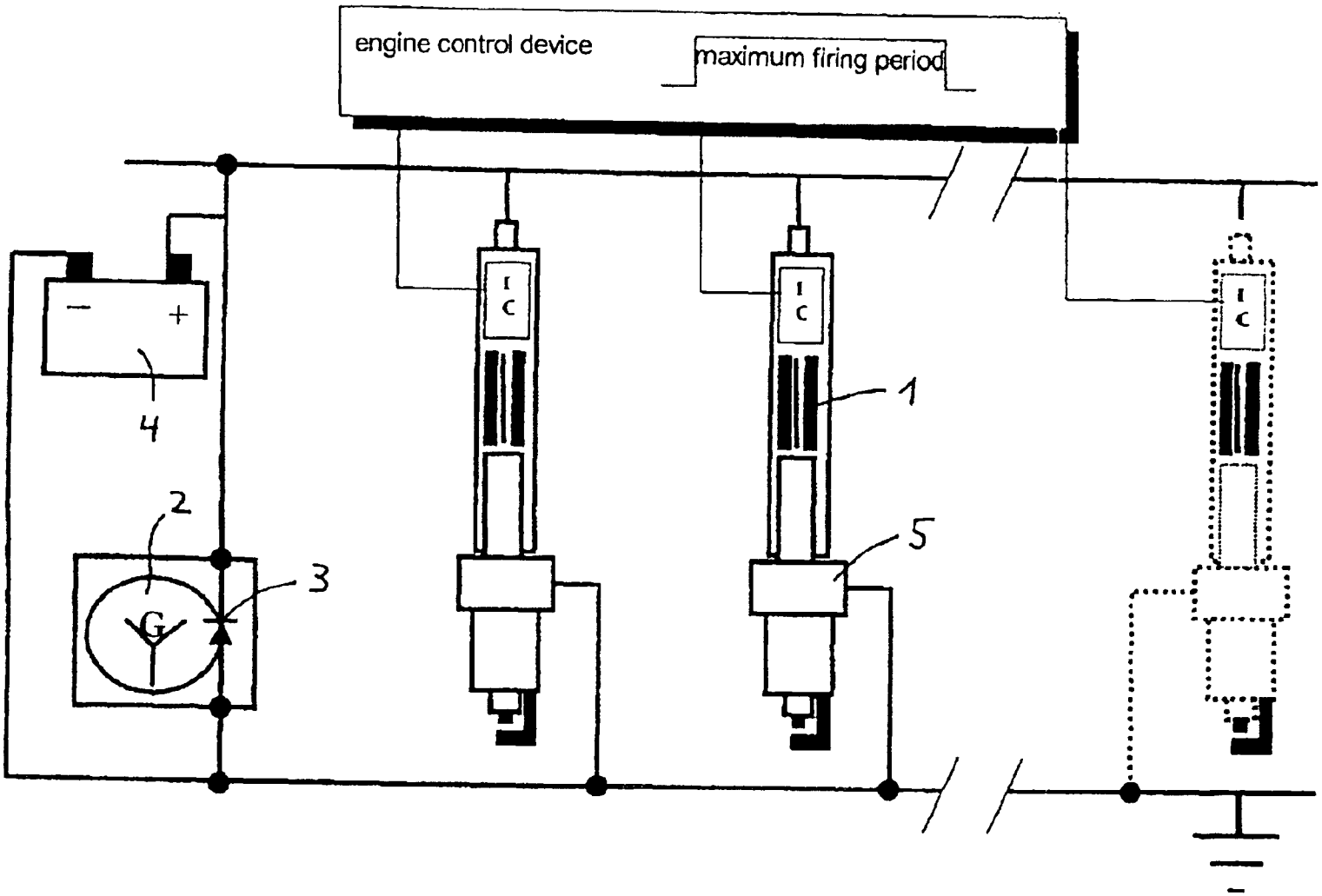
FIG. 3 shows a preferred embodiment of the invention having a plurality of rod ignition transformers in each of which the timed control means and the current control means for the ignition spark are respectively integrated.

FIG. 3 shows a preferred embodiment of the invention. A plurality of integrated rod ignition transformers are supplied with the on-board power system voltage from an on-board power system, and each rod ignition transformer with integrated electronic ignition system is actuated by an engine control device, as described in conjunction with FIG. 2, using an actuation signal as time window for the maximum firing period. The electronic ignition system which is described in conjunction with FIG. 1 and is composed of an ignition control device 7, semiconductor power stage 6 and the current sensor for measuring the primary current, is integrated in the form of an integrated circuit IC into each respective rod ignition transformer. The IC performs the current limitation and time control in the same way as described in conjunction with FIGS. 1 and 2. The number of integrated rod ignition transformers which are supplied with voltage by the on-board power system depends on the number of combustion chambers in the engine and on the number of spark plugs provided per cylinder.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An ignition system for an internal combustion engine comprising:

an on-board power system voltage supply;

at least one electronic ignition system;

at least one ignition transformer; and at least one spark plug; wherein the on-board power system voltage is applied to the primary side of the ignition transformer;

during a time window which is predefined by an actuation signal a timed control operation with superimposed maximum current limitation is carried out by the electronic ignition system for the primary current in the ignition transformer such that, at a start of the time window, the spark breakdown is achieved at the spark plug because the primary current is switched off for a predefined first time interval after a predefined limiting value has been reached;

the primary current is alternately switched on and off up to an end of the time window by timed control with superimposed maximum current limitation; and the timed control operates with time intervals of 10–200 miscroseconds for the switch on time $t_{on}$, and with time intervals of 5 to 50 microseconds for the switch off time $t_{off2}$.

2. The ignition system as claimed in claim 1, wherein after the spark discharge with the primary current switched on, a portion of the primary current is used to maintain the spark current and a portion of the primary current is used to build up a post-ignition reserve in the form of magnetic energy which is stored in the ignition transformer.

3. The ignition system as claimed in claim 1, wherein a reverse blocking diode is connected between the ignition transformer and the electronic ignition system.

4. The ignition system as claimed in claim 1, wherein the spark plug and the ignition transformer are embodied as rod ignition transformers.

5. The ignition system as claimed in claim 1, wherein the electronic ignition system, the ignition transformer and the spark plug are integrated in an ignition unit.

6. The ignition system as claimed in claim 5, wherein the electronic ignition system is formed separately from the rod ignition transformer.

7. The ignition system as claimed in claim 5, wherein the electronic ignition system contains an ignition control device, a semiconductor power stage and a current sensor.

8. The ignition system as claimed in claim 7, wherein the reverse blocking diode is connected between the drain terminal of the output stage of the semiconductor power stage and the primary winding of the ignition transformer.

9. The ignition system as claimed in claim 7, wherein the electronic ignition system is embodied as an integrated circuit.

10. The ignition system as claimed in claim 1, wherein the timed control operates with selected, predefined time intervals.

11. The ignition system as claimed in claim 10, wherein the predefined time intervals are selected as a function of operating conditions prevailing in the internal combustion engine.

12. The ignition system as claimed in claim 1, wherein the ignition transformer has a transmission ratio greater than 50.

* * * * *